US009568008B2

(12) United States Patent
Huang et al.

(10) Patent No.: US 9,568,008 B2
(45) Date of Patent: Feb. 14, 2017

(54) ROTOR STRUCTURE OF FAN AND MANUFACTURING METHOD THEREOF

(71) Applicant: Delta Electronics, Inc., Taoyuan Hsien (TW)

(72) Inventors: Yueh-Lung Huang, Taoyuan Hsien (TW); Chien-Ming Lee, Taoyuan Hsien (TW); Tine-Kun Lin, Taoyuan Hsien (TW); Hai-Feng Li, Taoyuan Hsien (TW); Ming-Kai Hsieh, Taoyuan Hsien (TW); Chien-Chih Lee, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 570 days.

(21) Appl. No.: 14/143,944

(22) Filed: Dec. 30, 2013

(65) Prior Publication Data

US 2015/0064009 A1 Mar. 5, 2015

(30) Foreign Application Priority Data

Sep. 4, 2013 (CN) ..... 2013 1 0398834

(51) Int. Cl.

| | |
|---|---|
| ***F04D 29/05*** | (2006.01) |
| ***F04D 29/60*** | (2006.01) |
| ***F04D 19/00*** | (2006.01) |
| ***F04D 25/06*** | (2006.01) |
| ***F04D 29/26*** | (2006.01) |

(52) U.S. Cl.

CPC ..... *F04D 19/002* (2013.01); *F04D 25/0613* (2013.01); *F04D 29/263* (2013.01)

(58) Field of Classification Search

CPC ... F04D 19/002; F04D 25/0631; F04D 29/263

See application file for complete search history.

(56) References Cited

U.S. PATENT DOCUMENTS

| | | | | |
|---|---|---|---|---|
| 3,385,516 | A * | 5/1968 | Omohundro | F04D 25/082 416/186 R |
| 4,583,911 | A * | 4/1986 | Braun | F04D 29/681 415/116 |
| 6,832,895 | B2 * | 12/2004 | Yoshioka | F03D 1/02 416/183 |
| 7,063,507 | B2 * | 6/2006 | Hsieh | F04D 29/662 415/119 |
| 7,214,032 | B2 * | 5/2007 | Yu | H05K 7/20172 415/213.1 |
| 8,147,203 | B2 * | 4/2012 | Chen | F04D 29/263 415/213.1 |
| 8,974,199 | B2 * | 3/2015 | Schmid | F04D 29/662 417/423.7 |
| 9,182,008 | B2 * | 11/2015 | Liedel | F16F 15/32 |

* cited by examiner

*Primary Examiner* — Igor Kershteyn

(74) *Attorney, Agent, or Firm* — Muncy, Geissler, Olds & Lowe, P.C.

(57) ABSTRACT

A rotor structure of a fan includes a bushing, a hub, a shaft and a plurality of blades. The hub has a top portion and a sidewall, and the top portion of the hub covers the bushing. The hub and the bushing are made by the same material. One end of the shaft is connected to the bushing, and the shaft is disposed inside the top portion. The blades are disposed on the outer side of the sidewall of the hub. A manufacturing method of the rotor structure is also disclosed.

16 Claims, 8 Drawing Sheets

ROTOR STRUCTURE OF FAN AND MANUFACTURING METHOD THEREOF

CROSS REFERENCE TO RELATED APPLICATIONS

This Non-provisional application claims priority under 35 U.S.C. §119(a) on Patent Application No(s). 201310398834.8 filed in People's Republic of China on Sep. 4, 2013, the entire contents of which are hereby incorporated by reference.

BACKGROUND OF THE INVENTION

Field of Invention

The invention relates to a fan and a manufacturing method thereof and, in particular, to a rotor structure of a fan and a manufacturing method thereof.

Related Art

A rotor is commonly applied to a fan by a rivet bushing method. FIG. 1A is a schematic sectional diagram of a conventional rotor structure, and FIG. 1B is a flow chart of a manufacturing method of the conventional rotor structure. As shown in FIGS. 1A and 1B, the conventional rotor structure 1 includes a shaft 11, a magnetically permeable shell 12 and a copper bushing 13. The conventional manufacturing method includes the step S10 in which the shaft 11 and the copper bushing 13 are connected to each other by interference fit, and thereby the shaft 11 is provided with the copper bushing 13. The step S10 also can be called a copper rivet process. Then, the shaft 11 is riveted to the magnetically permeable shell 12 through the copper bushing 13 (step S12), and in other words, the copper bushing 13 connected to the shaft 11 is riveted to the magnetically permeable shell 12 in this step. Finally, a hub 14 and a plurality of blades 15 are formed on the outer side of the magnetically permeable shell 12 by injection molding (step S14), and the blades 15 are disposed on the periphery of the hub 14.

However, in the step S12 of the manufacturing method of the conventional rotor 1 structure, the copper bushing 13 needs to be compressed to connect to the magnetically permeable shell 12. Therefore, the structural strength and the resistance to shock of the conventional rotor structure 1 are limited in a certain degree. Especially in the case of the heavier conventional rotor 1 bearing larger inertial force during the motion of rotation, thus the structural strength will be overloaded. Therefore, the rivet portion of the conventional rotor 1 may be broken or loosed so that the shaft 11 separates from the magnetically permeable shell 12, resulting in the dangerous situation in usage.

Besides, the copper bushing 13 has a larger weight and the production cost thereof is also relative higher. Furthermore, when the magnetically permeable shell 12 is riveted to the shaft 11 through the copper bushing 13, a precise fit for the magnetically permeable shell 12 and the copper bushing 13 is required. In addition, the assembly error and insufficient connection strength may be caused by the fit condition of the jig and copper bushing 13 during the rivet process (S12).

Therefore, it is an important subject to provide a rotor structure of a fan and a manufacturing method thereof in which the copper bushing and the rivet process for the shaft and copper bushing are omitted so that the manufacturing process is simplified and the structural strength of the rotor structure is increased.

SUMMARY OF THE INVENTION

In view of the foregoing subject, an objective of the invention is to provide a rotor structure of a fan and a manufacturing method thereof in which the copper bushing and the rivet process for the shaft and copper bushing are omitted so that the manufacturing process is simplified and the structural strength of the rotor structure is increased.

To achieve the above objective, a rotor structure of a fan according to the invention includes a bushing, a hub, a shaft and a plurality of blades. The hub has a top portion and a sidewall, and the top portion of the hub covers the bushing. The hub and the bushing are made by the same material. One end of the shaft is connected to the bushing, and the shaft is disposed inside the top portion. The blades are disposed on the outer side of the sidewall of the hub.

In one embodiment, the end of the shaft includes a first connection portion connected to the bushing.

In one embodiment, the bushing is exposed from the top portion of the hub.

In one embodiment, the bushing includes at least two opposite second connection portions.

In one embodiment, the second connection portions are disposed at the edges of the bushing symmetrically.

In one embodiment, the second connection portions are disposed at the edges of the bushing asymmetrically.

In one embodiment, the bushing includes a main body and an extension extending from the main body along the shaft.

In one embodiment, the rotor structure further comprises a magnetically permeable shell disposed inside the sidewall of the hub.

To achieve the above objective, a manufacturing method of a rotor structure of a fan according to the invention comprises steps of: providing a shaft; forming a bushing on one end of the shaft by injection molding; and forming a hub on the bushing and a plurality of blades on the periphery of the hub by injection molding, wherein the hub has a top portion and a sidewall, the top portion covers the bushing, and the hub and the bushing are made by the same material.

In one embodiment, the step of forming the bushing on the end of the shaft by injection molding further comprises steps of: embossing the end to form a first connection portion, and forming the bushing on the first connection portion by injection molding.

In one embodiment, the step of forming the bushing on the end of the shaft by injection molding further comprises a step of: solidifying the bushing.

In one embodiment, the bushing is exposed from the top portion of the hub.

In one embodiment, the step of forming the bushing on the end of the shaft by injection molding further comprises a step of: forming at least two opposite second connection portions.

In one embodiment, the second connection portions are disposed at the edges of the bushing symmetrically.

In one embodiment, the second connection portions are disposed at the edges of the bushing asymmetrically.

In, one embodiment, the bushing includes a main body and an extension extending from the main body along the shaft.

In one embodiment, the step of forming the hub on the bushing and the blades by injection molding further comprises a step of: covering a magnetically permeable shell inside the sidewall of the hub.

As mentioned above, in the rotor structure of a fan and the manufacturing method thereof according to the invention, the bushing is first formed on the shaft by injection molding, and then the hub and the blades are formed on the bushing by injection molding, and the top portion of the hub covers the bushing. This two-steps injection molding process can leave out the conventional rivet step for the shaft and copper bushing, so the process can be simplified and the metal material (for the copper bushing) can be further saved in the invention. Therefore, the cost of the process and the production is reduced in the invention. Besides, the effect of even or same material distribution can be achieved in the invention by using the two-steps injection molding process, and the strength of the rotor structure can be thus enhanced. In detail, by using the same material to form the hub and bushing, the connection between the hub and shaft can be strengthened, and the strength of the rotor structure can be thus enhanced.

Besides, the end of the shaft includes the first connection portion that is formed by embossing processing. The first connection portion is a rugged structure that can strengthen the connection between the bushing and the shaft, so that the whole strength of the rotor structure is enhanced. Furthermore, the bushing includes at least two opposite second connection portions so as to increase the torsional resistance of the rotor structure during the rotation. The second connection portions can be disposed on the opposite edges of the bushing symmetrically, or can be disposed on the upper and lower edges respectively and asymmetrically. Especially, the said asymmetrical structure can increase the pulling-resistant force of the bushing to the mold so as to advantage the mold stripping procedure after forming the bushing.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 2A:
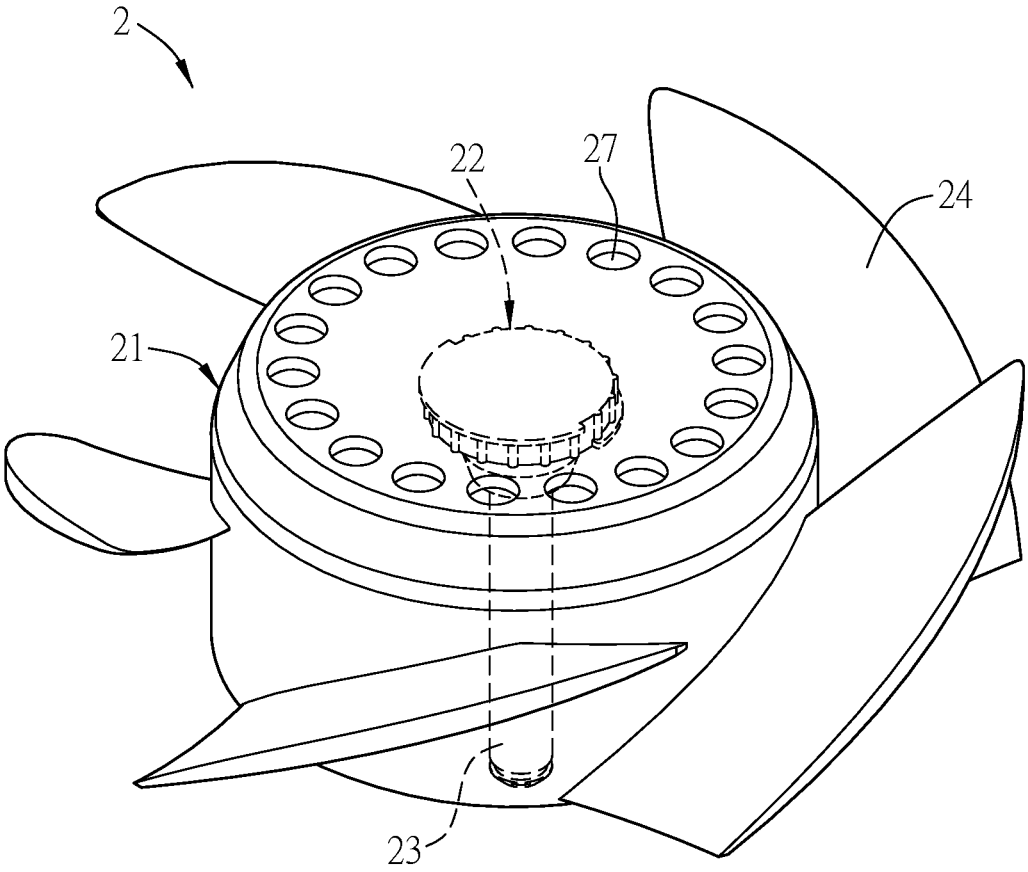
FIG. 2A is a schematic diagram of a rotor structure according to an embodiment of the invention.
Figure 2B:
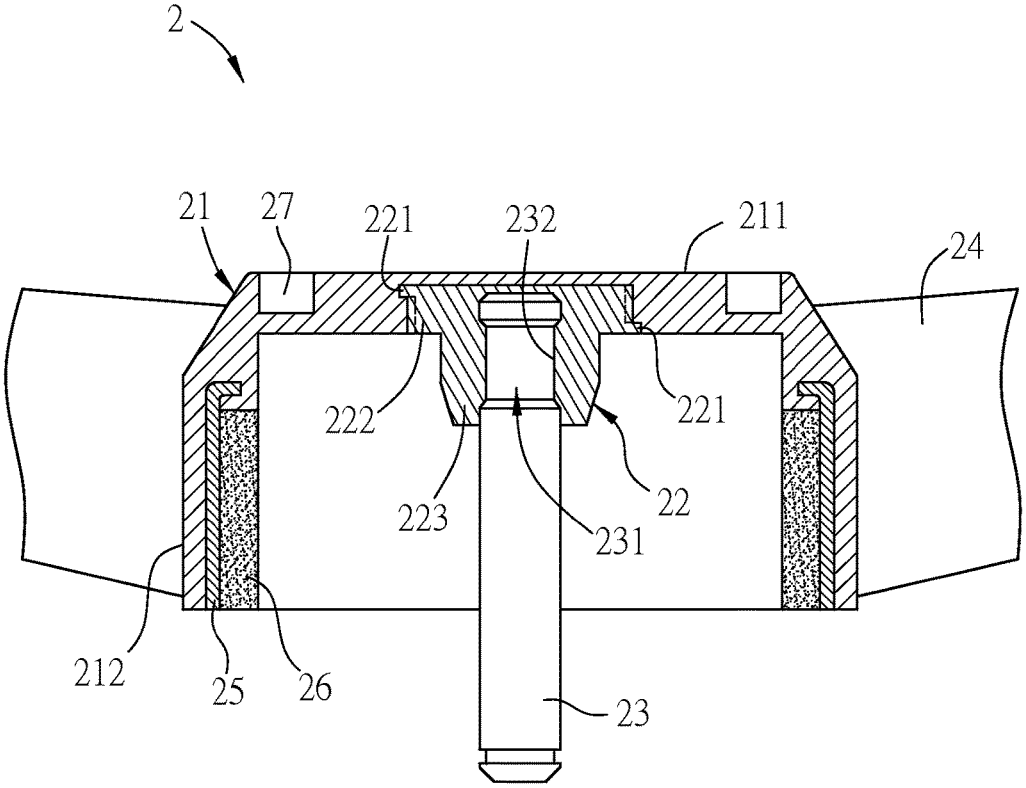
FIG. 2B is a sectional diagram of the rotor structure in FIG. 2A.

FIG. 2A is a schematic diagram of a rotor structure according to an embodiment of the invention, and FIG. 2B is a sectional diagram of the rotor structure in FIG. 2A. As shown in FIGS. 2A and 2B, a rotor structure 2 of a fan includes a hub 21, a bushing 22, a shaft 23 and a plurality of blades 24. The hub 21 includes a top portion 211 and at least a sidewall 212. The bushing 22 is connected to the top portion 211 of the hub 21. The top portion 211 of the hub 21 covers the bushing 22 in this embodiment, and the bushing 22 is disposed inside and fixed to the top portion 211. The hub 21 and the bushing 22 are made by the same material. One end 231 of the shaft 23 is connected to the bushing 22. The shaft 23 is disposed inside the top portion 211. The blades 24 are disposed on the periphery of outer surface of the sidewall 212 of the hub 21.

Figure 3:
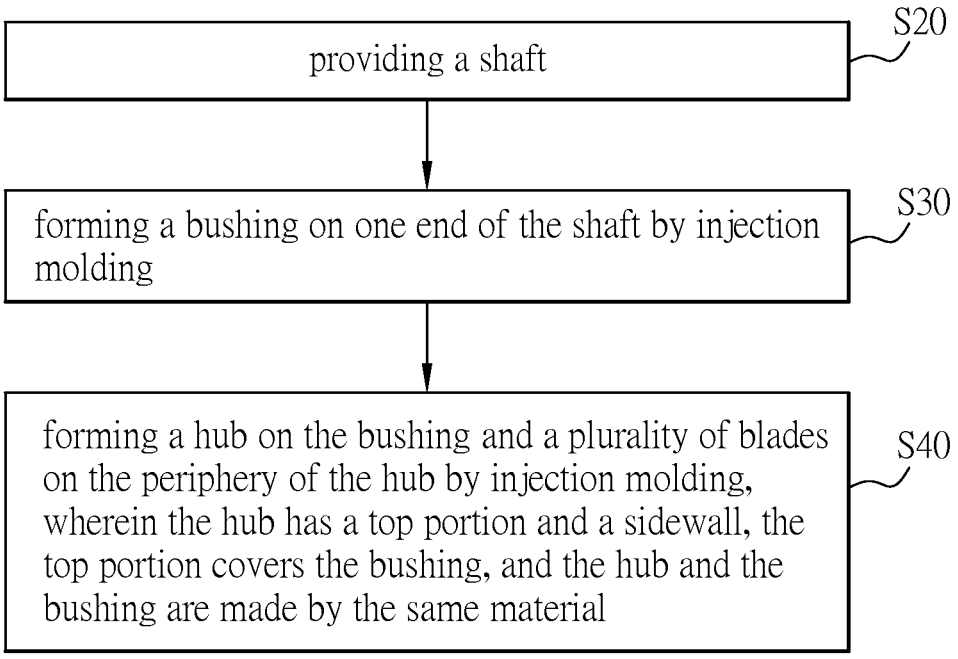
FIG. 3 is a flowchart of a manufacturing method of a rotor structure according to an embodiment of the invention.

The manufacturing method of the rotor structure 2 is illustrated as below in cooperation with the related figures. FIG. 3 is a flowchart of a manufacturing method of a rotor structure according to an embodiment of the invention. As shown in FIGS. 2A, 2B and 3, the manufacturing method of the rotor structure 2 includes the steps of: providing a shaft (step S20); forming a bushing on one end of the shaft by injection molding (step S30); and forming a hub on the bushing and a plurality of blades on the periphery of the hub by injection molding, wherein the hub has a top portion and a sidewall, the top portion covers the bushing, and the hub and the bushing are made by the same material (step S40). In the steps S20 and S30, a shaft 23 is provided, and a bushing 22 is formed on the end 231 of the shaft 23 by injection molding. In detail, the shaft 23 is positioned in the mold (not shown) that is designed according to the form of the bushing 22, and then the injection molding process (or called the process of wrapping by injection) is performed after the mold is closed, so the bushing 22 is formed on the end 231 of the shaft 23.

Figure 4:
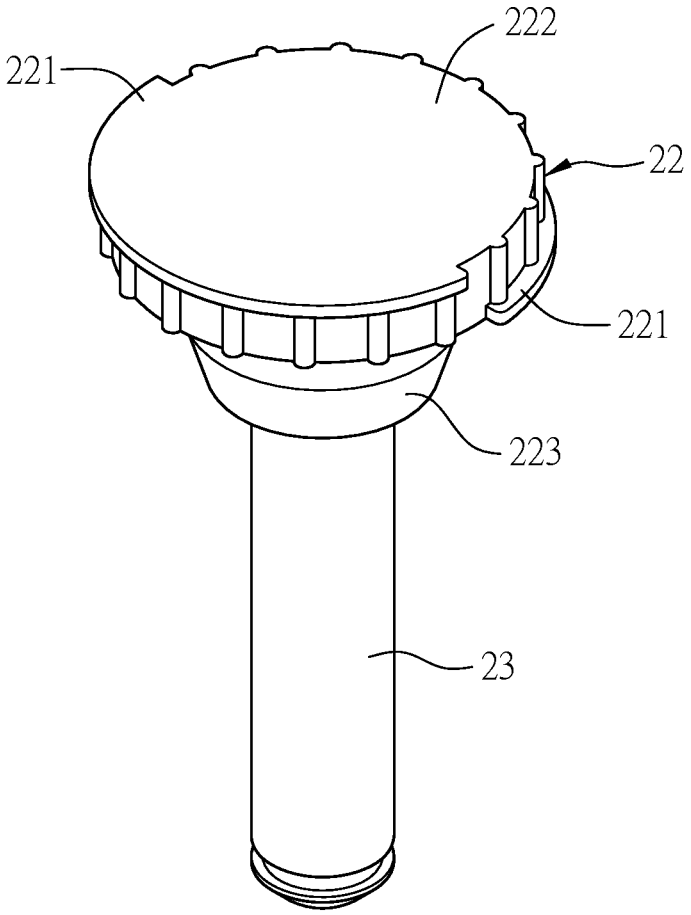
FIG. 4 is a schematic diagram of the connection between the bushing and shaft in FIG. 2A.
Figure 5:
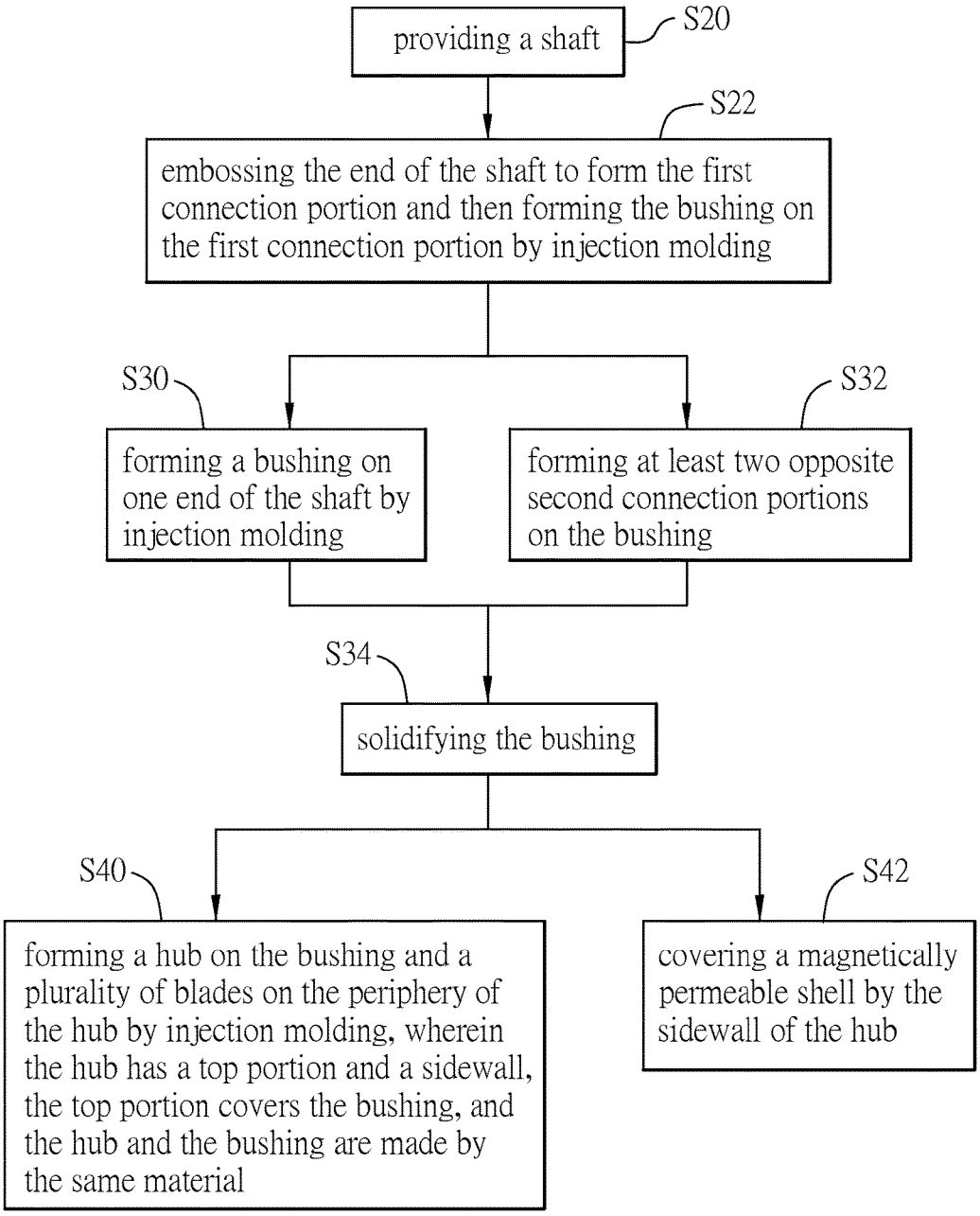
FIG. 5 is a flowchart of a manufacturing method of a rotor structure according to another embodiment of the invention.

FIG. 4 is a schematic diagram of the connection between the bushing and shaft in FIG. 2A. As shown in FIGS. 2B and 4, the bushing 22 preferably includes a main body 222 and at least two opposite second connection portions 221 extending from the main body 222. In this embodiment, the bushing 22 includes two second connection portions 221, and they are disposed at the opposite edges of the bushing 22 symmetrically. In detail, the said symmetrical disposition means the two second connection portions 221 are disposed on the opposite sides of the main body 222 of the bushing 22. By disposing the second connection portions 221 at the edges of the bushing 22 in this embodiment, the torsional resistance of the rotor structure during the motion of rotation can be enhanced. FIG. 5 is a flowchart of a manufacturing method of a rotor structure according to another embodiment of the invention. As shown in FIGS. 2B, 4 and 5, the step S30 can further includes a step S32 for forming at least two opposite second connection portions 221 on the bushing 22. Since the second connection portions 221 are clearly illustrated as above, the description thereof is omitted here for conciseness.

Otherwise, the two second connection portions 221 can also be disposed at the opposite edges of the bushing 22 asymmetrically (not shown), as a more favorable case. As an embodiment, the said asymmetrical disposition means the two second connection portions 221 are disposed at the upper and lower edges of the bushing 22, respectively, to form an asymmetrical structure. In this embodiment, the two connection portions 221 asymmetrical are protrusions respectively disposed on the upper and lower edges of the bushing 22 oppositely, and the width of the second connection portion 221 protruding from the main body 222 is one sixteenth (1/16) of the radial length of the main body 222 as a favorable case. To be noted, the form of the second connection portion 221 is not limited in this invention, and it can have a concave form for example. Such kind of asymmetrical structure is more favorable for the mold stripping procedure of the injection molding process, in which the pulling-resistant force of the bushing 22 to the mold is increased due to the asymmetrical structure.

Favorably, a pre-process can be conducted to the shaft 23 before the step S30. As shown in FIGS. 2B and 5, before forming the bushing 22 on the end 231 of the shaft 23 by injection molding (step S30), the manufacturing method can further include a step S22, which is to emboss the end 231 of the shaft 23 to form a first connection portion 232 of the shaft 23 and then to form the bushing 22 on the first connection portion 232 by injection molding. In other words, the end 231 of the shaft 23 includes the first connection portion 232, and the first connection portion 232 is a rugged structure formed by the emboss processing for example. In detail, in the emboss processing, an acid/alkali-resistant printing ink is applied to a pre-determined position of the end 231 of the shaft 23 in order to preserve the embossment, and then a little sulfuric acid solution and nitric acid solution containing cupric sulphate and iron(II) chloride as the metal corrosion solution is used to eat the unprotected portion to form the first connection portion 232. Then, in the step S30 (or the later section of the step S22), the bushing 22 is formed on the first connection portion 232 as well as the end 231 of the shaft 23 by injection molding to make the first connection portion 232 and the bushing 22 become a firmly-connected body. The first connection portion 232 can strengthen the connection between the bushing 22 and the shaft 23, and the strength of the rotor structure 2 is thus increased.

In addition to the main body 222, the bushing 22 can further include an extension 223 as shown in FIGS. 2B and 4. In this case, the extension 223 extends from the main body 222 along the axial direction of the shaft 23 to cover the whole embossment of the first connection portion 232 so that the connection between the bushing 22 and shaft 23 can be further strengthened. To be noted, by the specific design of the mold, the main body 222 and the extension 223 of the bushing 22 can be formed on the end 231 of the shaft 23 at the same time during the injection molding process.

In the step S40 as shown in FIG. 3 or 5, the hub 21 and the blades 24 are formed on the bushing 22 by injection molding, and the blades 24 are disposed on the periphery of outer surface of the hub 21, i.e. the periphery of outer surface of the sidewall 212. In detail, the bushing 22 is positioned in the mold having the form according to the hub 21 and the blades 24, and then the hub 21 and the blades 24 are formed on the bushing 22 by injection molding. The top portion 211 of the hub 21 covers the bushing 22, which means the bushing 22 is disposed inside the top portion 211 and fixed to a predetermined position of the top portion 211. In this embodiment, the main body 222 of the bushing 22 is completely contained by the top portion 211 of the hub 21, so that the bushing 22 is not exposed to the outer surface of the top portion 211 for keeping the hub 21 a good appearance. Besides, in the steps S30 and S40, the hub 21 and the bushing 22 are formed by using the same material in the two-steps injection molding processes. Preferably, the said material is a plastic material.

Figure 1A:
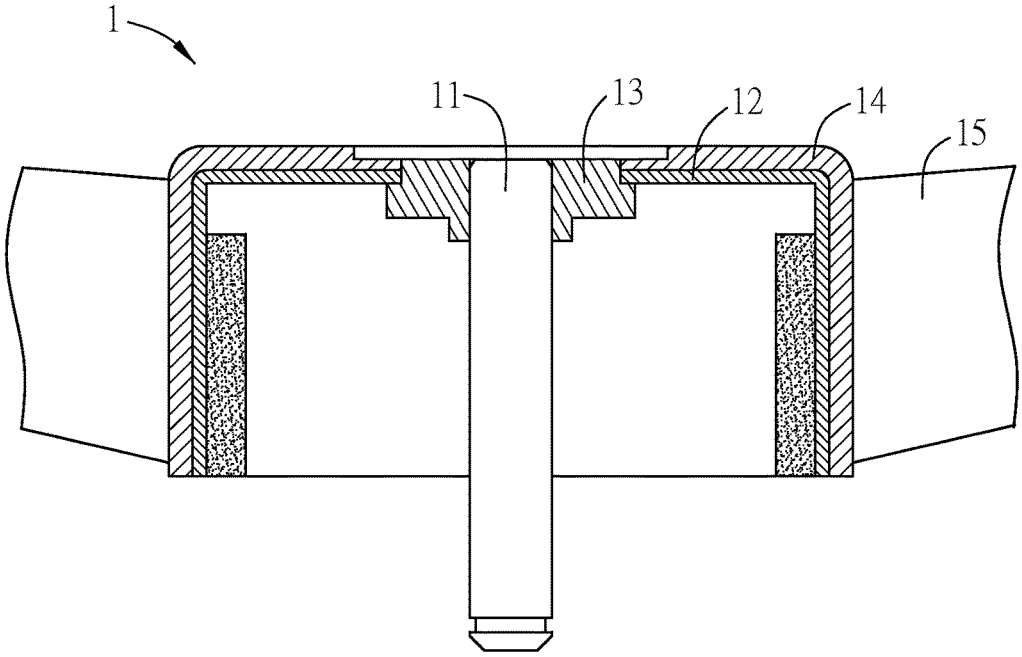
FIG. 1A (Prior Art)
FIG. 1A is a schematic sectional diagram of a conventional rotor structure.
Figure 1B:
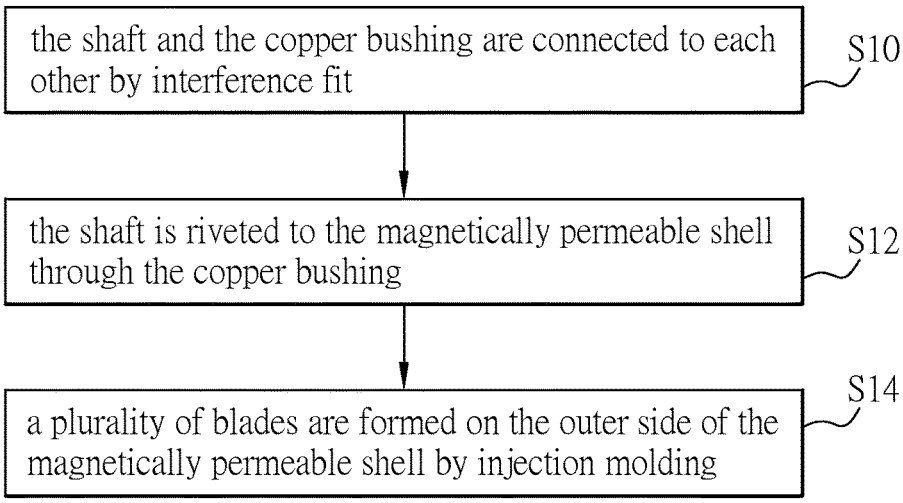
FIG. 1B (Prior Art)
FIG. 1B is a flow chart of a manufacturing method of the conventional rotor structure.

In the invention, the two-steps injection molding process is disclosed to form the bushing 22 on the shaft 23 first and then the hub 21 on the bushing 22, and thereby the conventional rivet process for the shaft and bushing can be omitted and also the metal material (for the conventional copper bushing) can be saved, so the cost of the production and process can be reduced. Besides, in the conventional art, the hub is formed on the periphery of the magnetically permeable shell (riveted to the copper bushing) by injection molding (referring to the conventional step S14 in FIG. 1B), however, this kind of one-step injection molding process often causes the problem of uneven material distribution, so the strength of the connection between the hub and shaft is decreased, and the strength of the whole rotor structure is thus deteriorated. By contrast, the even material distribution is achieved in the invention by using the two-steps injection molding process. Therefore, in the invention, the connections among the hub 21, bushing 22 and shaft 23 are both strengthened more, in contrast to the prior art. In other words, by forming the hub 21 and the bushing 22 with the same material, the connection between the hub 21 and shaft 23 is strengthened, so that the torsion of the rotor structure 2 is maintained or even enhanced. Below is a torsion testing result between the rotor structure of the prior art and the rotor structure 2 of the invention with the same specifications. The rotor structure 2 of this embodiment has a radius of 12.5 mm, which means the distance from the sidewall 212 to the center of the shaft 23 is 12.5 mm. From the result of the testing, the maximum torsion of the conventional rotor structure is between 7.6 and 8.0 (kg-cm), but the maximum torsion of the rotor structure 2 of this embodiment can reach between 13.7 and 14.2 (kg-cm), which is more than double in quantity. Therefore, it is obvious that the rotor structure 2 of the invention can bear more torsion. In the case of the tensile testing result, the tensile that the rotor structure can bear generally must be greater than 20 kg/min. The tensile that the rotor structure of the prior art can bear is 25~26 kg/min, and the tensile the rotor structure 2 of this embodiment can bear is up to 29~30 kg/min, so the strength of the rotor structure 2 is obviously greater than the conventional rotor structure.

Favorably, as shown in FIGS. 2B and 5, after the step S30 forming the bushing 22 on the end 231 of the shaft 23 by injection molding, the manufacturing method can further include a step S34, which is to solidify the bushing 22. In detail, after the step S30 for forming the bushing 22 by injection molding, the step S40 forming the hub 21 and the blades 24 on the bushing 22 by injection molding can't be conducted until the step S34 therebetween solidifying the bushing 22 is completed.

As shown in FIG. 2B, the rotor structure 2 can further include a magnetically permeable shell 25, which is disposed inside the sidewall 212 of the hub 21. In the manufacturing process, when the hub 21 and blades 24 are formed on the bushing 22 by injection molding (step S40), a magnetically permeable shell 25 can be covered inside the sidewall 212 of the hub 21 (step S42). In detail, the magnetically permeable shell 25 and the bushing 22 can be both positioned in the mold that is designed according to the form or shape of the hub 21 and blades 24, and then the injection molding is conducted to form the hub 21 with the sidewall 212 covering the magnetically permeable shell 25. Furthermore, the rotor structure 2 can further include a magnetic element 26 (referring to FIG. 2B), which is further disposed on the inner side of the formed magnetically permeable shell 25. In detail, as shown in FIG. 2B, the magnetically permeable shell 25 is disposed on the inner side of the sidewall 212 of the hub 21, and the magnetic element 26 is further disposed on the inner side of the formed magnetically permeable shell 25. The magnetic element 26 can be also positioned in the mold, just like the magnetically permeable shell 25 and the bushing 22, and then the injection molding is conducted. Since the related features are clearly illustrated as above, they are not described here for conciseness.

As shown in FIGS. 2A and 2B, the top portion 211 of the hub 21 can further include a plurality of balance holes 27, which can be filled with some objects, such as balance weighting blocks, so as to make the rotation of the rotor structure 2 more balanced by adding additional weight on the hub 21 properly.

Figure 6A:
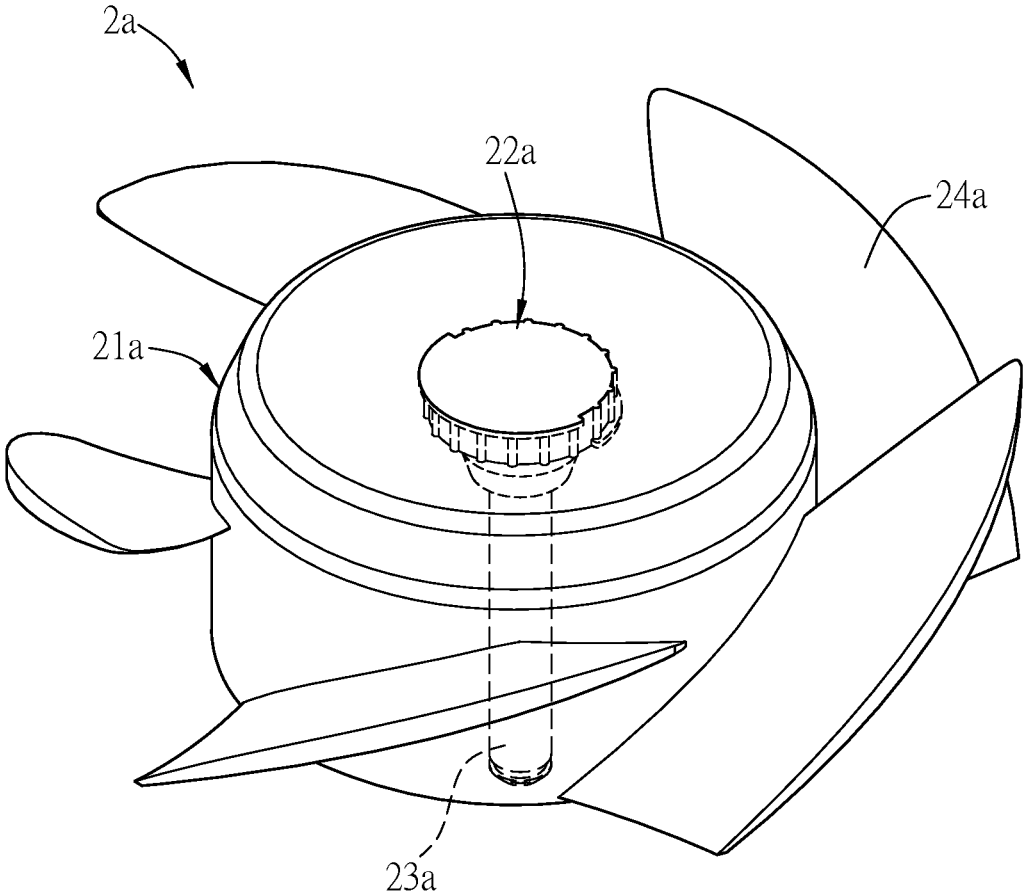
FIG. 6A is a schematic diagram of a rotor structure according to another embodiment of the invention.
Figure 6B:
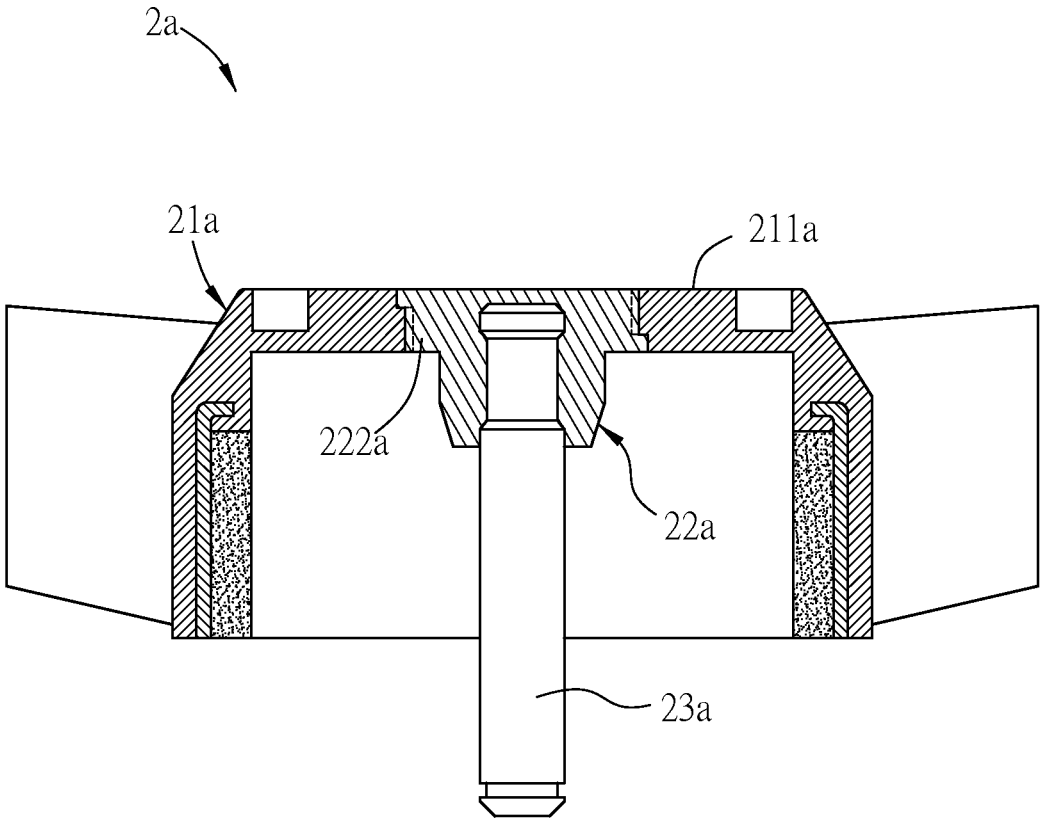
FIG. 6B is a sectional diagram of the rotor structure in FIG. 6A.

Other illustrative embodiments are shown in FIGS. 6A and 6B. FIG. 6A is a schematic diagram of a rotor structure according to another embodiment of the invention, and FIG. 6B is a sectional diagram of the rotor structure in FIG. 6A. A bushing 22*a* of a rotor structure 2*a* as shown in FIGS. 6A and 6B, which is similar to the bushing 22 of the rotor structure 2*a* as shown in FIGS. 2A and 2B of the above-mentioned embodiments. The bushing 22*a* of this embodiment can be disposed in and fixed to a top portion 211*a* of a hub 21*a* of the rotor structure 2*a*, and can be exposed from the top portion 211*a* of the hub 21*a*. In detail, in the step, which similar to step S30 as shown in FIG. 3 or 5, forming the bushing 22*a* on an end 231*a* of a shaft 23*a* of the rotor structure 2*a* by injection molding (may referring to the step of FIG. 3 or 5), a main body 222*a* of the bushing 22*a* can be formed as a larger or longer one by design of the mold. In the step, which similar to step S40 as shown in FIG. 3 or 5, forming the hub 21*a* on the busing 22*a* by injection molding, the main body 222*a* of the bushing 22*a* is positioned in the mold so that the surface of the main body 222*a* away from the shaft 23*a* contacts the mold, and then the injection molding is conducted to form the embodiment wherein the bushing 22*a* is exposed from the top portion 211*a* of the hub 21*a*, as a feature of this embodiment.

In summary, in the rotor structure of a fan and the manufacturing method thereof according to the invention, the bushing is first formed on the shaft by injection molding, and then the hub and the blades are formed on the bushing by injection molding, and the top portion of the hub covers the bushing. This kind of two-steps injection molding process can leave out the conventional rivet step for the shaft and copper bushing, so the process can be simplified and the metal material (for the copper bushing) can be saved in the invention. Therefore, the cost of the process and production is reduced in the invention. Besides, the effect of even material distribution can be achieved in the invention by using the two-steps injection molding process, and the strength of the rotor structure can be thus enhanced. In detail, by using the same material to form the hub and bushing, all of the connections between the hub and shaft can be indirectly strengthened, and the strength of the rotor structure can be thus enhanced.

Besides, the end of the shaft includes the first connection portion that is formed by embossing processing. The first connection portion is a rugged structure that can strengthen the connection between the bushing and the shaft, so that the whole strength of the rotor structure is enhanced. Furthermore, the bushing includes at least two opposite second connection portions so as to increase the torsional resistance of the rotor structure during the rotation. The second connection portions can be disposed on opposite sides of the bushing symmetrically, or can be disposed on the upper and lower edges respectively and asymmetrically. Especially, the said asymmetrical structure can increase the pulling-resistant force of the bushing to the mold so as to advantage the mold stripping procedure after forming the bushing.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A rotor structure of a fan, comprising:

a bushing;

a hub having a top portion and a sidewall, wherein the bushing is disposed inside and fixed to the top portion, and the hub and the bushing are made by the same material;

a shaft disposed inside the top portion and having one end connected to the bushing; and a plurality of blades disposed on the outer side of the sidewall.

2. The rotor structure as recited in claim 1, wherein the end of the shaft includes a first connection portion connected to the bushing.

3. The rotor structure as recited in claim 2, wherein the bushing includes at least two opposite second connection portions.

4. The rotor structure as recited in claim 3, wherein the second connection portions are disposed at the edges of the bushing symmetrically.

5. The rotor structure as recited in claim 3, wherein the second connection portions are disposed at the edges of the bushing asymmetrically.

6. The rotor structure as recited in claim 1, wherein the bushing includes a main body and an extension extending from the main body along the shaft.

7. The rotor structure as recited in claim 1, further comprising:

a magnetically permeable shell disposed inside the sidewall of the hub.

8. A manufacturing method of a rotor structure of a fan, comprising steps of:

providing a shaft;

forming a bushing on one end of the shaft by injection molding; and forming a hub on the bushing and a plurality of blades on the periphery of the hub by injection molding, wherein the hub has a top portion and a sidewall, the top portion covers the bushing, and the hub and the bushing are made by the same material.

9. The manufacturing method as recited in claim 8, wherein the step of forming the bushing on the end of the shaft by injection molding further comprises steps of:

embossing the end to form a first connection portion, and forming the bushing on the first connection portion by injection molding.

10. The manufacturing method as recited in claim 8, wherein the step of forming the bushing on the end of the shaft by injection molding further comprises a step of:

solidifying the bushing.

11. The manufacturing method as recited in claim 8, wherein the bushing is exposed from the top portion of the hub.

12. The manufacturing method as recited in claim 9, wherein the step of forming the bushing on the end of the shaft by injection molding further comprises a step of:

forming at least two opposite second connection portions.

13. The manufacturing method as recited in claim 12, wherein the second connection portions are disposed at the edges of the bushing symmetrically.

14. The manufacturing method as recited in claim 12, wherein the second connection portions are disposed at the edges of the bushing asymmetrically.

15. The manufacturing method as recited in claim 8, wherein the bushing includes a main body and an extension extending from the main body along the shaft.

16. The manufacturing method as recited in claim 8, wherein the step of forming the hub on the bushing and the blades by injection molding further comprises a step of:

covering a magnetically permeable shell inside the sidewall of the hub.

* * * * *